US005810269A

United States Patent [19]

Shannon

[11] Patent Number: 5,810,269

[45] Date of Patent: Sep. 22, 1998

[54] GYRATORY CRUSHER

[75] Inventor: James William Shannon, City Beach, Australia

[73] Assignee: Wescone Crushers Pty. Ltd., Australia

[21] Appl. No.: 849,427

[22] PCT Filed: Dec. 1, 1995

[86] PCT No.: PCT/AU95/00803

§ 371 Date: May 30, 1997

§ 102(e) Date: May 30, 1997

[87] PCT Pub. No.: WO96/16738

PCT Pub. Date: Jun. 6, 1996

[30] Foreign Application Priority Data

Dec. 2, 1994 [AU] Australia ..... PM9855

[51] Int. Cl.[6] ..... B02C 2/04; B02C 2/06

[52] U.S. Cl. ..... 241/207; 241/209; 241/212

[58] Field of Search ..... 241/207, 208, 241/209, 212

[56] References Cited

U.S. PATENT DOCUMENTS

| | | | |
|---|---|---|---|
| 28,031 | 4/1860 | Wood | 241/212 |
| 180,620 | 8/1876 | Motte | 241/212 |
| 348,757 | 9/1886 | McCully | 241/209 |
| 500,597 | 7/1893 | McCully | 241/209 |
| 799,647 | 9/1905 | Hart | 241/209 |
| 997,918 | 7/1911 | Jones | 241/212 |
| 1,549,555 | 8/1925 | Jorgensen . | |
| 2,327,384 | 8/1943 | Annesley | 241/216 |
| 2,579,239 | 12/1951 | Lippmann | 241/215 |
| 2,787,424 | 4/1957 | Lippmann | 241/216 |
| 2,787,425 | 4/1957 | Gruender | 241/290 |
| 2,901,189 | 8/1959 | Conway | 241/207 |
| 2,972,448 | 2/1961 | Dorsey | 241/286 |
| 3,080,126 | 3/1963 | Kueneman et al. | 241/216 |
| 3,312,404 | 4/1967 | Allen | 241/215 |
| 3,345,000 | 10/1967 | Decker et al. | 241/209 |
| 3,446,445 | 5/1969 | Maslennikov et al. | 241/209 |
| 3,565,353 | 2/1971 | Adam | 241/207 |
| 3,743,193 | 7/1973 | DeDiemar et al. | 241/207 |
| 3,744,728 | 7/1973 | Treppish | 241/207 |
| 3,750,967 | 8/1973 | DeDiemar et al. | 241/207 |
| 3,771,735 | 11/1973 | Decker et al. | 241/216 |
| 3,813,047 | 5/1974 | Torrence et al. | 241/211 |
| 3,837,585 | 9/1974 | Decker et al. | 241/213 |
| 3,873,037 | 3/1975 | Decker et al. | 241/211 |
| 3,957,213 | 5/1976 | Stockman et al. | 241/202 |
| 4,027,825 | 6/1977 | Coxhill | 241/213 |
| 4,034,922 | 7/1977 | Coxhill | 241/213 |
| 4,037,800 | 7/1977 | Coxhill | 241/213 |
| 4,084,756 | 4/1978 | Coxhill | 241/213 |
| 4,192,472 | 3/1980 | Johnson | 241/215 |
| 4,198,003 | 4/1980 | Polzin et al. | 241/30 |
| 4,206,881 | 6/1980 | Werginz | 241/207 |
| 4,272,030 | 6/1981 | Afanasiev et al. | 241/37 |
| 4,316,585 | 2/1982 | Guzik | 241/211 |

(List continued on next page.)

FOREIGN PATENT DOCUMENTS

| | | | |
|---|---|---|---|
| 618545 | 2/1989 | Australia | B02C 2/04 |
| 2 463 640 | 2/1981 | France | B02C 2/06 |
| WO 89/00455 | 1/1989 | WIPO | B02C 2/04 |

OTHER PUBLICATIONS

Derwent Abstract Accession No. 87–256073/36, SU, A. 898460 (Komm Mine Metal Ins), 30 Jan. 1987.

*Primary Examiner*—John M. Husar
*Attorney, Agent, or Firm*—Wolf, Greenfield & Sacks, P.C.

[57] ABSTRACT

A gyratory crusher for crushing frangible or friable material where the crushing head is supported for drive in gyratory movement within the bowl, in which the head gyrates on a gyratory axis which is inclined with respect to, and intersects the central axis of the bowl, at an angle which is substantially fixed in use of the crusher. The head is supported by a bearing system including a first bearing component which is secured in relation to the crushing head and a second component which is mounted in relation to a frame. Drive is achieved by a mechanical arrangement in which, during its gyratory motion, the gyratory axis traverses a substantially fixed cone of revolution which has its apex at the intersection of the gyratory axis and the central axis of the bowl.

19 Claims, 8 Drawing Sheets

U.S. PATENT DOCUMENTS

| | | | |
|---|---|---|---|
| 4,339,087 | 7/1982 | Pollak | 241/211 |
| 4,351,490 | 9/1982 | Johnson | 241/286 |
| 4,391,414 | 7/1983 | Reiter | 241/213 |
| 4,410,143 | 10/1983 | Polinski | 241/209 |
| 4,478,373 | 10/1984 | Gieschen | 241/208 |
| 4,512,525 | 4/1985 | Cameron | 241/207 |
| 4,585,179 | 4/1986 | Tsuji et al. | 241/101.7 |
| 4,592,517 | 6/1986 | Zarogatsky et al. | 241/207 |
| 4,602,746 | 7/1986 | Stockmann et al. | 241/215 |
| 4,615,491 | 10/1986 | Batch et al. | 241/37 |
| 4,679,741 | 7/1987 | Hansen | 241/206 |
| 4,681,269 | 7/1987 | Arawaka | 241/101.2 |
| 4,787,563 | 11/1988 | Tanaka et al. | 241/208 |
| 4,844,362 | 7/1989 | Revnivtsev et al. | 241/210 |
| 4,892,257 | 1/1990 | Stoeckmann et al. | 241/32 |
| 4,895,311 | 1/1990 | Arawaka | 241/207 |
| 4,976,470 | 12/1990 | Arawaka | 241/37 |
| 5,035,368 | 7/1991 | Finley et al. | 241/212 |
| 5,115,991 | 5/1992 | Saari et al. | 241/208 |
| 5,152,468 | 10/1992 | Virtamo et al. | 241/213 |
| 5,190,229 | 3/1993 | Kaiser | 241/207 |
| 5,312,053 | 5/1994 | Ganser, IV | 241/30 |
| 5,350,125 | 9/1994 | Clark | 241/208 |

GYRATORY CRUSHER

FIELD OF THE INVENTION

This invention relates to an improved gyratory crusher and, in particular, to a gyratory crusher having an improved mounting by which a crushing head of the crusher is supported for drive in gyratory movement within a bowl.

BACKGROUND OF THE INVENTION

In a gyratory crusher of the type to which the present invention relates, the head is required to gyrate on a gyratory axis which is inclined with respect to, and intersects a central axis of the bowl, at an angle which is substantially fixed in use of the crusher. The nature of the gyratory motion varies with the location of the point of intersection between the gyratory and central axes. At least in a preferred form of the crusher of the present invention, the point of intersection is located proximate to, or co-incident with, a plane extending across the lower end of the head, as with the gyratory crusher disclosed in Australian patent specification 618545 (AU-B-19935/88), corresponding to WO 89/00455. Indeed, the present invention, in such preferred forms, provides improvements in the crusher of specification 618545 and, for ease of description, the present invention is described in the context of arrangements having the point of intersection of the gyratory and central axes which is proximate to or co-incident with such plane. However, it is to be understood that the improvements of the present invention have application in gyratory crushers in which that point of intersection is at other locations. That is, the point of intersection can be spaced from, either above or below, rather than proximate to a plane extending across the lower end of the crushing head.

In the gyratory crusher of Australian patent specification 618545, the crushing head has a lower support which comprises a hemispherical bearing or knuckle. An upper support and drive take the form of an upper shaft which has an axis which is co-incident with the central axis of the bowl of the crusher and a lower eccentrically inclined shaft which has an axis co-incident with the gyratory axis for the head. The upper shaft is confined in a vertical aspect by bearings located in a rigid upper frame of the crusher, while the crushing head is mounted concentrically on the lower shaft by bearings therebetween. Drive to the upper shaft causes gyratory motion of the head due to eccentric engagement between a lower face of the upper shaft and an upper face of the lower shaft.

The hemispherical knuckle of the crusher of specification 618545 is located in a socket in a lower frame of the crusher, with its convex, upwardly-facing hemispherical bearing surface have a centre of curvative co-incident with the central axis of the bowl. At the lower end of both the lower shaft and the crushing head, there is a housing defining a concave, hemispherical seating which fits accurately and closely over the knuckle. The arrangement necessitates that the axis of the lower shaft, and hence the gyratory axis of the head, intersects the central axis of the bowl at the centre of curvature of the knuckle bearing surface.

In use, it is found that there can be problems with the crusher disclosed in specification 618545. Trouble-free operation necessitates a high level of dimensional accuracy in the manufacture of all components, and a high level of skill both in initial assembly of the components by the manufacturer and in re-assembly after servicing by operators. This is because:

(i) the upper shaft must have its axis co-incident with the central axis, necessitating bearings for the upper shaft being concentric with the central axis;

(ii) the lower shaft must have its axis co-incident with the gyratory axis, necessitating bearings for the lower shaft being concentric with the gyratory axis;

(iii) the gyratory axis must intersect the central axis at the centre of curvature for the bearing surface of the knuckle; and (iv) the spherical surface of the housing and the bearing surface of the knuckle must be in appropriate sliding contact without overloading of any of the bearings.

Simply attaining these conditions presents difficulties, but re-establishing them after at least partial disassembly for service also requires a high level of expertise. Also, it is necessary that the conditions be retained during use, which can present further difficulties.

When friable and frangible material is crushed in an upper region of a crushing chamber between the bowl and head, and before it is crushed sufficiently to descend to a lower region of the chamber, substantially horizontal crushing forces are transmitted to the knuckle and the housing defining the seat thereon. The curvature of the contacting surfaces of the knuckle and the housing results in those forces being difficult to resist, as the forces are resolved to generate vertical components acting to separate the knuckle and housing. Such separation, insofar as it is able to occur as a consequence of variation in manufacturing tolerances of components, causes movement of the intersection of the gyratory axis with the central axis away from the centre of curvative of the surface of the knuckle, with generation of overload forces in the shafts and their bearings, and risk of failure. While the knuckle may be vertically adjustable to achieve contact between its surface and that of the housing, and location of that intersection on its centre of curvature, it is difficult to allow for compensating adjustments to offset the action of such vertical force components. Thus, there can be difficulty in maintaining condition (iv) under all operating conditions.

Also, attainment of conditions (i) to (iii) after assembly or re-assembly can not readily by tested. Moreover, maintenance of those conditions can be problematic in use, due to variation in dimensions of components as a result of thermal expansion. However, if conditions (i) to (iii) are not attained and maintained, very large forces generated in use can overload the shafts and/or their bearings and cause premature failure.

SUMMARY OF THE INVENTION

The present invention is directed to providing an improved gyratory crusher. As specified above, the improved crusher is of the type in which the crushing head is supported for drive in gyratory movement within the bowl, in which the head gyrates on a gyratory axis which is inclined with respect to, and intersects the central axis of the bowl, at an angle which is substantially fixed in use of the crusher. That is, the head is supported and driven by a mechanical arrangement in which, during its gyratory motion, the gyratory axis traverses a substantially fixed cone of revolution which has its apex at the intersection of the gyratory axis and the central axis of the bowl. The crusher of the invention thus is distinguished from centrifugal or inertial crushers in which the inclination of the gyratory axis, with respect to the axis of the bowl, varies with the speed at which the crusher is driven and the resistance of material being crushed in the crushing cavity. In the crusher of the invention, the inclination of the gyratory axis with respect to axis of the bowl does not vary with the speed at which the crusher is driven and reference hereinafter to the crusher of the invention is to be understood as being to a crusher of the type specified.

A gyratory crusher according to the invention includes a frame and a bowl mounted in relation to the frame. The bowl defines a chamber for receiving frangible or friable material to be crushed, and further defines a discharge opening at the base thereof through which crushed material is able to discharge. The bowl has a substantially vertical central axis. A crushing head is mounted in the bowl on a gyratory axis which is inclined with respect to, and intersects the central axis, at a substantially fixed angle. The crusher also has a drive assembly for imparting gyratory motion to the head, such that frangible or friable material received into the chamber is subjected to crushing action, between an inner peripheral surface of the bowl and an outer peripheral surface of the head, as the head is driven in its gyratory motion while maintaining the substantially fixed angle between the gyratory and central axes. The crusher further includes a bearing system by which the crushing head is mounted such that the gyratory axis intersects the central axis at said substantially fixed angle. The bearing system includes a first bearing component which is secured in relation to crushing head and a second component which is mounted in relation to the frame. One of the bearing components includes a bearing member which has a part-spherical ball, and the other of the components includes a bearing housing which defines a part-spherical cavity in which the ball is neatly received and secured. The bearing system is such that the intersection of the gyratory and central axes at said substantially fixed angle is defined by the common centre of the ball and cavity. Gyratory movement of the crushing head is permitted by corresponding movement of the first bearing component on, or in, the other bearing component. The ball is neatly received and secured in the cavity by the ball being at least partly enclosed below and above a horizontal plane through the centre of the ball and cavity, such that the centre of the ball is maintained substantially co-incident with the centre of the cavity in use of the crusher.

In a first arrangement, the first bearing component, that is, the one secured in relation to the crushing head, is the one which includes a bearing member having a part spherical ball. In that first arrangement, the bearing member includes a stem which projects from the ball, with the stem providing means by which the first bearing component is secured in relation to the crushing head. The stem may provide such means by being disposed with its longitudinal axis co-incident with the gyratory axis and, for example, locating securely in a housing on which the crushing head is mounted.

In a second arrangement, the first bearing component includes the bearing housing which defines the part-spherical cavity. In that case, the second component, that is, the one secured in relation to the frame, is the one which includes a bearing member having a part-spherical ball. Again, the bearing member has a stem which projects from the ball but, in this case, the stem provides means by which the second member is secured in relation to the frame. The stem may provide such means by being disposed with its longitudinal axis co-incident with the central axis and, for example, locating securely in a bearing or housing mounted in relation to the frame.

The drive assembly for imparting gyratory motion to the crushing head includes a drive shaft and drive means for rotating the drive shaft. Also, the drive shaft is confined so that its longitudinal axis is co-incident with the central axis. The drive assembly may be above or below the crushing head.

The crushing head may be mounted on a gyratory shaft, although there are arrangements possible in which such shaft is not required. However, in each case, the crushing head has an axis which is co-incident with the gyratory axis and, where provided, the gyratory shaft has its longitudinal axis co-incident with the gyratory axis.

In top drive arrangements, that is, arrangements in which the drive assembly is provided above the crushing head, there typically is a gyratory shaft. In such case, the drive shaft and the gyratory shaft are in an eccentric relationship. For such relationship, the drive shaft and the gyratory shaft may comprise parts of a unitary shaft assembly. Alternatively, those shafts may be separate, but having an eccentric coupling therebetween.

In a bottom drive arrangement, there may be a gyratory shaft and, where this is the case, there is an eccentric relationship between the drive shaft and the gyratory shaft. However, bottom drive arrangements which do not require a gyratory shaft are possible. Thus, there may be a direct eccentric relationship between a lower end of the crushing head, or a housing within the crushing head, and an inclined end face of the drive shaft. In such case, the eccentric relationship most preferably is in a plane which is perpendicular to the gyratory axis and which contains the point of intersection of the central and gyratory axes.

In each arrangement of the invention, the intersection of the gyratory and central axes most preferably is proximate to or co-incident with a plane extending across the lower end of the crushing head. This is beneficial, in that it results in an efficient crushing action in which gyratory movement of the head is substantially horizontal at the upper extent of the head and substantially vertical at its lower extent.

BRIEF DESCRIPTION OF THE FIGURES

In order that the invention can more readily be understood, description is now directed to the accompanying drawings, in which.

DETAILED DESCRIPTION

Figure 1:
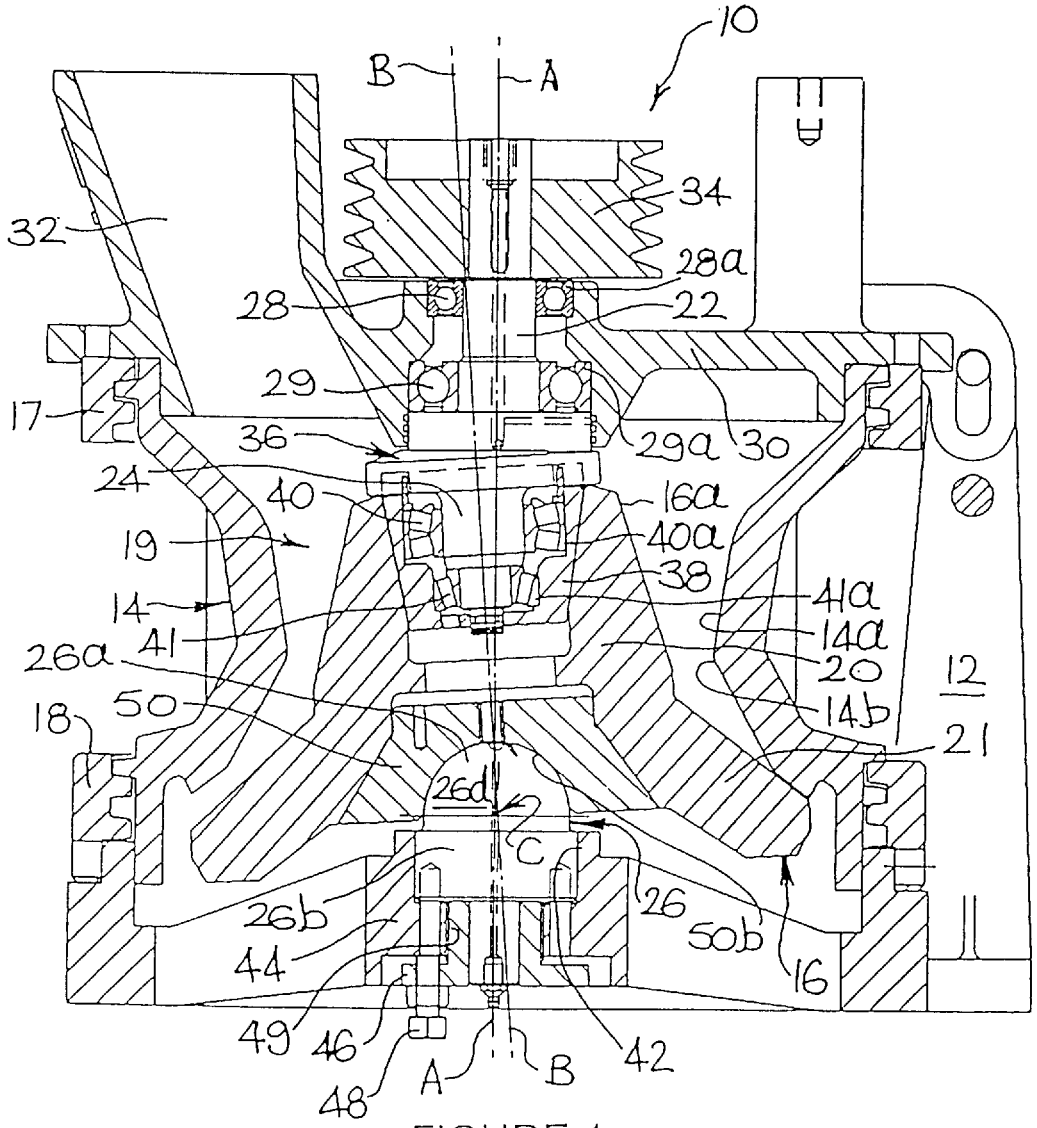
FIGURE 1 (PRIOR ART)
FIG. 1 is a vertical sectional view illustrating the arrangement of a gyratory crusher in accordance with the disclosure of Australian patent specification 618545.

In FIG. 1, there is shown a known form of gyratory crusher 10 which has a main frame 12, a bowl 14 mounted in frame 12 and a gyratory crushing head 16 mounted within bowl 14. The bowl 14 is circular in horizontal section, and defines an internal crushing surface 14*a* which tapers downwardly and inwardly to a throat at 14*b*, and thereafter flares outwardly. The bowl 14 is secured at a required vertical height relative to head 16 by threaded engagement at its lower end with lower ring 18 of frame 12. A top mounting frame 30 is secured at a required height relative to head 16 by threaded engagement with upper ring 17. The bowl 14 has a vertical central axis A—A, and surface 14*a* defines the outer periphery of a crushing chamber 19 which extends around head 16.

The crushing head 16 is of annular transverse cross-section and has an external crushing surface 16*a* which co-operates with surface 14*a* for crushing frangible and friable material received into chamber 19. The head 16 has an upper portion 20 at which surface 16*a* is of frusto-conical form, and a lower skirt 21 at which surface 16*a* flares outwardly and downwardly to close proximity to the lower extent of surface 14*a*.

The crushing head 16 is mounted in bowl 14 by an upper shaft 22, a lower shaft 24 and a knuckle 26 mounted below shaft 24 and head 16. The upper shaft 22 is a drive shaft for crusher 10, and is confined so that its longitudinal axis is vertical and co-incident with central axis A—A of bowl 14. Upper shaft 22 is so confined by being rotatably mounted in rolling element bearings 28 and 29, with each of bearings 28 and 29 having a respective outer element 28*a* and 29*a* located in a rigid spider 30 of frame 12. The spider 30 also has integral therewith an inlet chute 32 by which material to be crushed is able to be charged to chamber 19. At its upper end, shaft 22 has mounted thereon a pulley 34 enabling upper shaft 22 to be driven via belts and a drive motor (not shown).

The lower shaft 24 is disposed within crushing head 16, and has its longitudinal axis co-incident with a gyratory axis B—B for head 16. This disposition of shaft 24 is maintained by an eccentric relationship at plane 36 between the lower end of shaft 22 and the upper end of shaft 24. That relationship may be achieved by shafts 22 and 24 being formed integrally or by a mechanical coupling between them. The crushing head 16 is concentrically mounted on lower shaft 24 by means of an annular upper bearing housing 38 secured within head 16 and twin rolling element bearing 40 and thrust bearing 41 disposed within housing 38 concentrically around shaft 24. Housing 38 and head 16 are in intimate contact over respective tapered surfaces such that housing 38 is releaseably secured in relation to head 16. The bearings 40 and 41 have a respective outer element 40*a* and 41*a* secured in housing 38.

The knuckle 26 has a head portion 26*a*, a central boss 26*b*, and a depending stem 26*c*. The head portion 26*a* has an upwardly convex hemispherical surface 26*d*. The knuckle 26 has an axis of symmetry through the head portion 26*a*, boss 26*b* and the stem 26*c* which is co-incident with the central axis A—A. The knuckle is mounted in a locating bore 42 in lower spider 44 of frame 12. For this, the stem 26*c* is received in an annular nut 46 which is threaded in bore 49 and bears against the underside of boss 26*b*, such that knuckle 26 can be raised or lowered along axis A—A by rotation of nut 46. With knuckle 26 at a 5 required height, nut 46 then is secured against rotation by a locking bolt 48.

Lower shaft 24 is maintained in the required disposition, in which its axis is co-incident with the gyratory axis B—B, by the previously described mounting of upper shaft 22 in bearings 28 and 29. Also, knuckle 26 engages with a lower housing 50 secured within the lower extent of crushing head 16. The lower housing 50 and head 16 are in intimate contact over respective tapered surfaces such that housing 50 is releaseably secured in relation to head 16. Upwardly from its lower surface 50*a*, housing 50 is recessed to define a concave hemispherical surface 50*b* which is complementary to surface 26*d* of knuckle 2*6*. However, surface 50*b* has an axis of symmetry which is co-incident with the axis of lower shaft 24 and, hence, with the gyratory axis B—B for head 16.

As indicated, the axes of upper shaft 22 and knuckle 26 are co-incident with the central axis A—A of bowl 14, while the axes of lower shaft 24 and hemispherical surface 50*b* of housing 50 are co-incident with the gyratory axis B—B for head 16. However, in addition to these requirements, it is necessary for satisfactory performance of crusher 10 for axes A—A and B—B to intersect at the centre of curvature C for surface 26*d* of knuckle 26. This point C also is the centre of curvature for surface 50*b* of housing 50.

With drive supplied to pulley 34, upper shaft 22 is rotated on central axis A—A and crushing head is caused to gyrate with angular movement of the gyratory axis B—B around the axis A—A. The crushing head 16 is able to rotate on axis B—B, subject to the constraint of material being crushed in chamber 19 and any mechanism fitted to crusher 10 to retard rotation of head 16. However, more important is the nature of the gyratory motion of head 16 which results from the requirements detailed above and the location of point C relative to a plane extending across the lower head of head 16. As evident from FIG. 1, point C is co-incident with, or at least proximate to, such plane. As a consequence of this, the combined action of bowl 14 and head 16 provides for efficient crushing of frangible and friable material received in chamber 19. This action minimises oversize product needing to be recycled and provides a crushed product typically of a relatively narrow size spectrum, and results from the gyratory movement of head 16 being substantially horizontal at the upper extent of upper portion 20 and substantially vertical at the lower effective extent of its skirt 21. The crushed material discharges from chamber 19 via the lower periphery of skirt 21 and passes to a collection region below frame 12.

Notwithstanding the benefits of crusher 10, there are practical difficulties. Thus, as detailed above, attaining intersection of axes A—A and B—B at point C, and being able to maintain this in use and after re-assembly, requires precision manufacture of components within narrow tolerances if the very large forces generated in use are to be accommodated without overloading shafts 22 and 24 and bearings 28, 29, 40 and 41. Also, considerable skill is necessary in assembly and re-assembly in ensuring the correct axial location of shafts 22 and 24, housings 38 and 50 and knuckle 26. Moreover, appropriate sliding engagement of surface 26*d* of knuckle 26 and surface 50*b* of housing 50 necessitates an appropriate axial force which maintains that engagement in use and, in particular, at the commencement of a crushing operation.

At the commencement of a crushing operation, with charging to chamber 19 of friable and frangible material to be crushed, initial crushing between surface 14*a* of bowl 14 and surface 16*a* of crushing head 16 can tend to occur at the upper end of portion 20 of head 16. Prior to partially crushed material descending to a lower region of chamber 19, in particular that part defined below throat 14*b* between bowl 14 and skirt 21 of head 16, crushing forces transmitted to knuckle 26 via frame 12 and to housing 50 via head 16 are substantially horizontal. Those forces are resolved at surfaces 26*d* and 50*b* to generate axial force components which tend to force surfaces 26*d* and 50*b* apart. Some separation can result from variations in manufacturing tolerances particularly as axial forces intended to maintain surfaces 26*d* and 50*b* in engagement can not be too high if binding between those surfaces, as well as between engaging surfaces at interface 36 between shafts 22 and 24, is to be avoided. When such separation is believed to have occurred, it can be eliminated by re-positioning knuckle 26 by rotation of nut 46, although this necessitates cessation of crushing and possible removal of material from chamber 19. Also, where separation of surfaces 26*d* and 50*b* is found to have occurred, this can already have resulted in damage to shaft 22 or 24 or more likely, to at least one of bearings 28, 29, 40 and 41.

Figure 2:
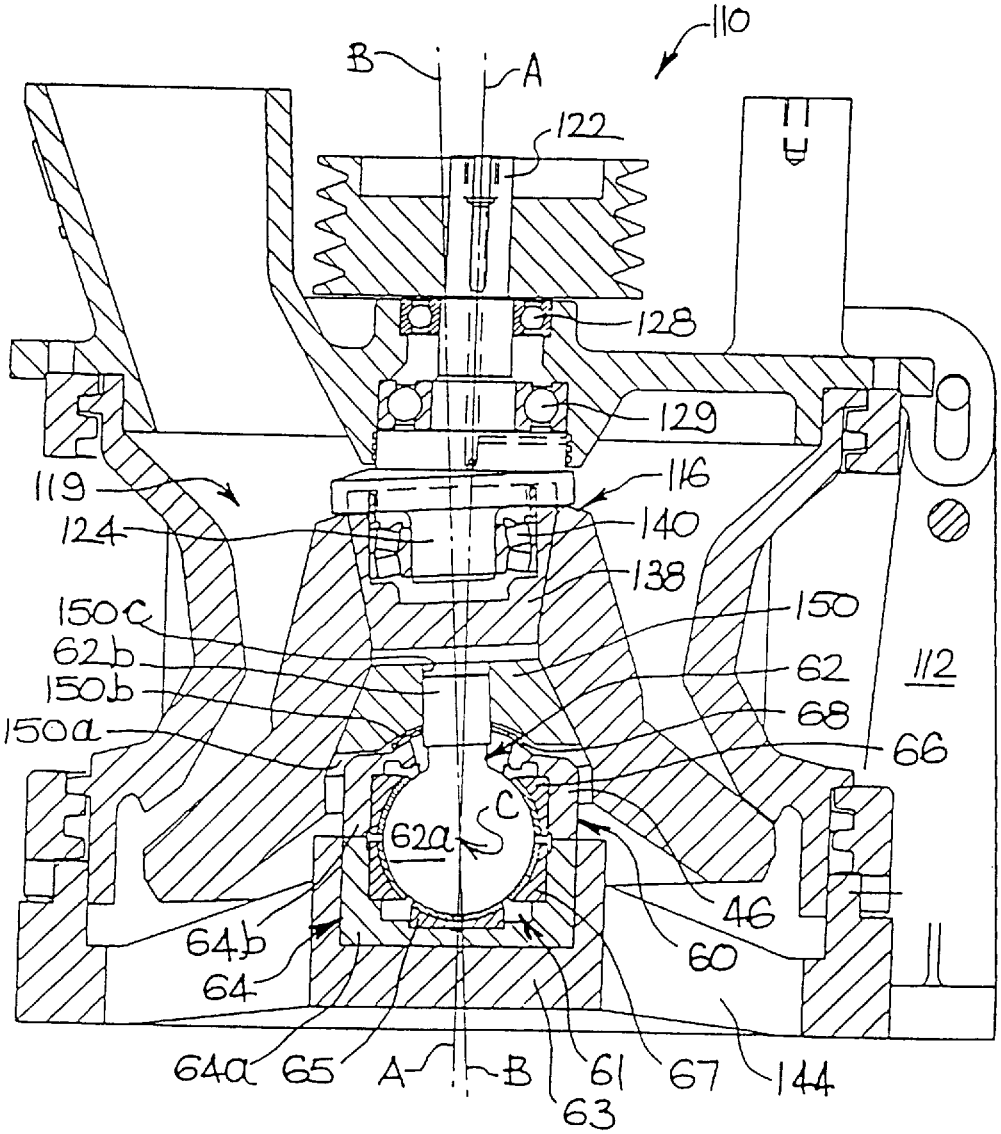
FIG. 2 is a view similar to that of FIG. 1, but illustrating a gyratory crusher according to a first embodiment of the present invention.
Figure 3:
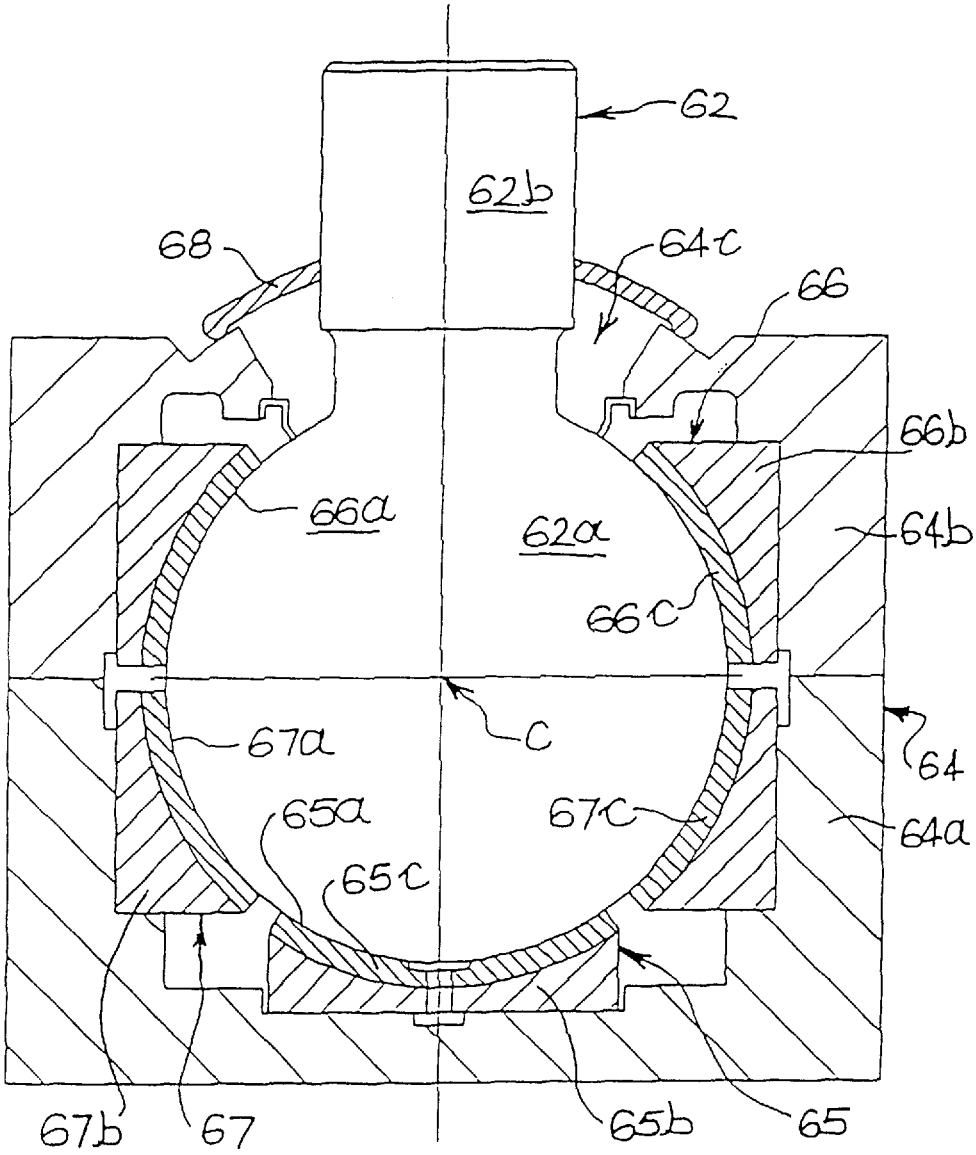
FIG. 3 shows an enlarged scale component of the crusher of FIG. 2.

FIGS. 2 and 3 show a gyratory crusher according to the present invention. As several components of this are similar to those of the crusher 10 of FIG. 1, they are identified by the same reference numeral, plus 100. The crusher 110 of FIGS. 2 and 3 enables retention of the benefits, while obviating or minimising disadvantages, of crusher 10.

Description of crusher 110 will be limited to features by which is differs from crusher 10. As will be apparent, a first difference is in the mounting of the crushing head 116 and the lower shaft 124, while a second difference is in an arrangement 60 which defines point C and maintains the disposition of shaft 124 such that its longitudinal axis is co-incident with the gyratory axis B—B.

While the mounting of shaft 122 is by means of bearings 128 and 129, shaft 124 is mounted in housing 138 only by twin roller bearing 140. A bearing 41 as in FIG. 1, for transferring axial forces, is found not to be necessary in view of arrangement 60. The bearing 140, as with bearing 40 of FIG. 1, is of a self-aligning design which can move slightly along the gyratory axis B—B. Thus small departures from narrow manufacturing tolerances and slight changes in geometry due, for example, to differential thermal expansion and contraction, do not impose unplanned or indeterminate loads on any of bearings 128, 129 and 140.

A more significant departure from crusher 10 is provided by arrangement 60 of crusher 110. Arrangement 60 has a housing 150, but of modified form. Also, knuckle 26 of crusher 10 has been replaced by a female bearing assembly 61 which is, in part, a mechanical inverse of knuckle 26, while housing 150 is provided with a male bearing member 62 which is received in assembly 61.

The bearing assembly 61 is mounted in a socket 63 defined by lower spider 144 of frame 112. Assembly 61 includes an outer casing 64 which has lower and upper parts 64*a* and 64*b* which are releaseably secured together and may be made, for example, of cast iron or steel. Assembly 61 also includes a basal bearing member 65 and upper and lower annular bearing members 66 and 67 which are securely mounted in casing 64. Each bearing 65, 66 and 67 has an inwardly facing bearing surface, respectively surfaces 65*a*, 66*a* and 67*a* (see FIG. 3). The surfaces 65*a*, 66*a* and 67*a* are part-spherical and have a common centre of curvature C.

The male bearing member 62 has a spherical head or ball 62*a* and a radial stem 62*b*. The ball 62*a* is received within a volume which is partly enclosed and defined by surfaces 65*a*, 66*a* and 67*a*. Also ball 62*a* has a radius such that it is neatly received in that volume to achieve sliding contact between its surface and surfaces 65*a*, 66*a* and 67*a*. To enable ball 62*a* to be so received, casing 64 defines an opening 64*c* through which stem 62*b* is able to project.

The modifications to housing 150 are such that it does not define a surface which, like surface 50*b* of housing 50 of FIG. 1, is a bearing surface. Thus, while the lower surface 150*a* of housing 150 is recessed to define a concave surface 15O*b*, this is to provide a clearance between housing 150 and casing 64. A further difference in housing 150 is that it defines an axial bore 150*c* which is concentric with gyratory axis B—B. Also, the radius of bore 150*c* is such that the upper end of stem 62*b* of bearing member 62 is securely but releaseably received therein. Thus member 62 functionally is substantially a continuation of an assembly comprising lower shaft 124 and crushing head 116, along gyratory axis B—B, and its stem 62*b* fixed relative to housing 150, by any suitable means, against movement along or laterally of axis B—B. As a consequence of this arrangement, stem 62*b* has its longitudinal axis co-incident with gyratory axis B—B. Also, axis B—B and central axis A—A intersect at point C; that is, at the centre of curvature for surfaces 65*a*, 66*a* and 67*a* of assembly 61 and the centre of ball 62*a* of bearing member 62.

As indicated, the upper end of stem 62*b* of bearing member 62 is securely, but releaseably, secured in bore 150*c* of housing 150. There is a number of ways in which this can be achieved. Thus, for example, stem 62*b* can be secured in bore 150*c* by heating housing 150 to enable insertion of stem 62*b* into bore 150*c*, and then allowing housing 150 to cool so as to achieve shrink-on engagement with stem 62*b*. Alternatively, stem 62*b* may have a smaller diameter than bore 150*c*, with securement of stem 62*b* in bore 150*c* being achieved by a screw-engaged conical locking ring system used for shaft and hub engagements, such as the system sold under the trade mark RINGBLOCK.

Between housing 150 and casing 64, an annular seal 68 is mounted on stem 62*b* of member 62. The seal 68 is slightly dished, so as to be concentric with surface 150*b*, and bears against a top surface of casing 64 around opening 64*c* of the latter, with that top surface being of complementary form to seal 68. Thus, seal 68 is able to prevent the ingress of dust into casing 64.

General operation of crusher 110 will be understood from the description of crusher 10 of FIG. 1. However, in operation with crusher 110, there are several benefits to be noted. The ball 62*a* of member 62 and the bearing assembly 61 are able to absorb all vertical axial crushing forces during the crushing of frangible and friable material within chamber 119. The ball 62*a* and assembly 61 share horizontal forces with bearing 140, with the proportion of such forces shared by each depending on the location in chamber 119 of material being crushed. Large material, when introduced to chamber 119, initially will be crushed high up in chamber 119 at the upper end of portion 120 of crushing head 116, and nearly all loads will be absorbed by bearing 140. As the material progresses downwards in chamber 119, the proportion of the total forces carried by ball 62*a* and assembly 61 will increase. When there is material in the lowest part of chamber 119, the forces will be predominantly vertical or axial and carried almost entirely by ball 62*a* and assembly 61, while horizontal forces also will be carried by ball 62*a* and assembly 61. Since bearing 140 does not share vertical or axial forces, and in any event can move slightly along gyratory axis B—B, the need for precision in manufacture, and in assembly and re-assembly, is significantly less critical than with crusher 10 of FIG. 1.

Horizontal forces, such as tending to separate housing 50 and knuckle 26 in crusher 10 of FIG. 1, are readily able to be carried by the ball 62*a* and assembly 61 of crusher 110. As ball 62*a* is substantially fully enclosed in assembly 61, with parts 64*a* and 64*b* of casing 64 secured together, separation of ball 62*a* from surfaces 65*a*, 66*a* and 67*a* is not possible. That is, ball 62*a* is constrained above a horizontal plane containing point C by its engagement by surface 66*a* of bearing 66 and below that plane by surfaces 65*a* and 67*a* of respective bearings 65 and 67. Also, parts 64*a* and 64*b* of casing 64 are secured in abutting assembly to retain bearings 65, 66 and 67 in position; while casing 64 is secured in fixed socket 63. Thus, the centre of ball 62*a* is retained co-incident with the intersection of axes A—A and B—B at point C.

A further benefit of the arrangement of crusher 110 is that thermal expansion and contraction is readily able to be accommodated by axial movement of bearing 140 on shaft 124. That is, a degree of relative movement of housing 138 along shaft 124 is possible along gyratory axis B—B, and this acts to minimise axial loading on bearing 140.

Casing 64 in FIG. 2 is not shown as secured in socket 63. However, securement means preferably is provided. Also, while casing 64 is shown as simply sitting in socket 63, it preferably is adjustable along central axis A—A for precision in locating point C at the intersection of axes A—A and B—B. In an arrangement providing both securement means and for adjustment, casing 64 may be mounted in socket 63 in a manner analogous to the mounting of knuckle 26 in crusher 10 of FIG. 1. Thus a threaded bore concentric with axis A—A can be provided in the base of socket 63, with a depending stem on the underside of part 64*a* extending through an annular adjustment nut engaged in that bore. A locking bolt also can be provided to prevent rotation of the nut and thereby retain casing 64 at a required height established by prior rotation of the nut.

Further detail of assembly 61 is more readily apparent in FIG. 3. As shown in FIG. 3, each of bearing numbers 65, 66 and 67 is of composite construction such as a bimetallic construction, and comprises a backing part 65*b*, 66*b* and 67*b* and a low friction, wear resistant bearing part 65*c*, 66*c* and 67*c* which defines the respective one of surfaces 65*a*, 66*a* and 67*a*. The parts 65*b*, 66*b* and 67*b* may, for example, be of cast iron, steel or a copper based alloy. The bearing parts 65*c*, 66*c* and 67*c* may, for example, be of white metal or Babbit's metal. However, bearing parts 65*c*, 66*c* and 67*c* also can be of non-metallic material, such as a suitable ceramic.

As indicated, axis B—B is inclined with respect to vertical, central axis A—A so that these axes intersect at point C. In use of crusher 110, the angle between axis B—B and axis A—A is fixed, such as shown. Thus, during gyratory motion of head 116, axis B—B moves around a cone of revolution which has its apex at point C and a half cone angle corresponding to that fixed angle. As will be appreciated, the fixed angle is maintained by constraints resulting from the mounting of shaft 122 in bearings 128 and 129; the eccentricity between shafts 122 and 124; and the securement of bearing member 62 such that its ball 62*a* is secured within casing 64 with its centre co-incident with point C and its stem 62*b* secured in bore 150*c* of housing 150.

Figure 4:
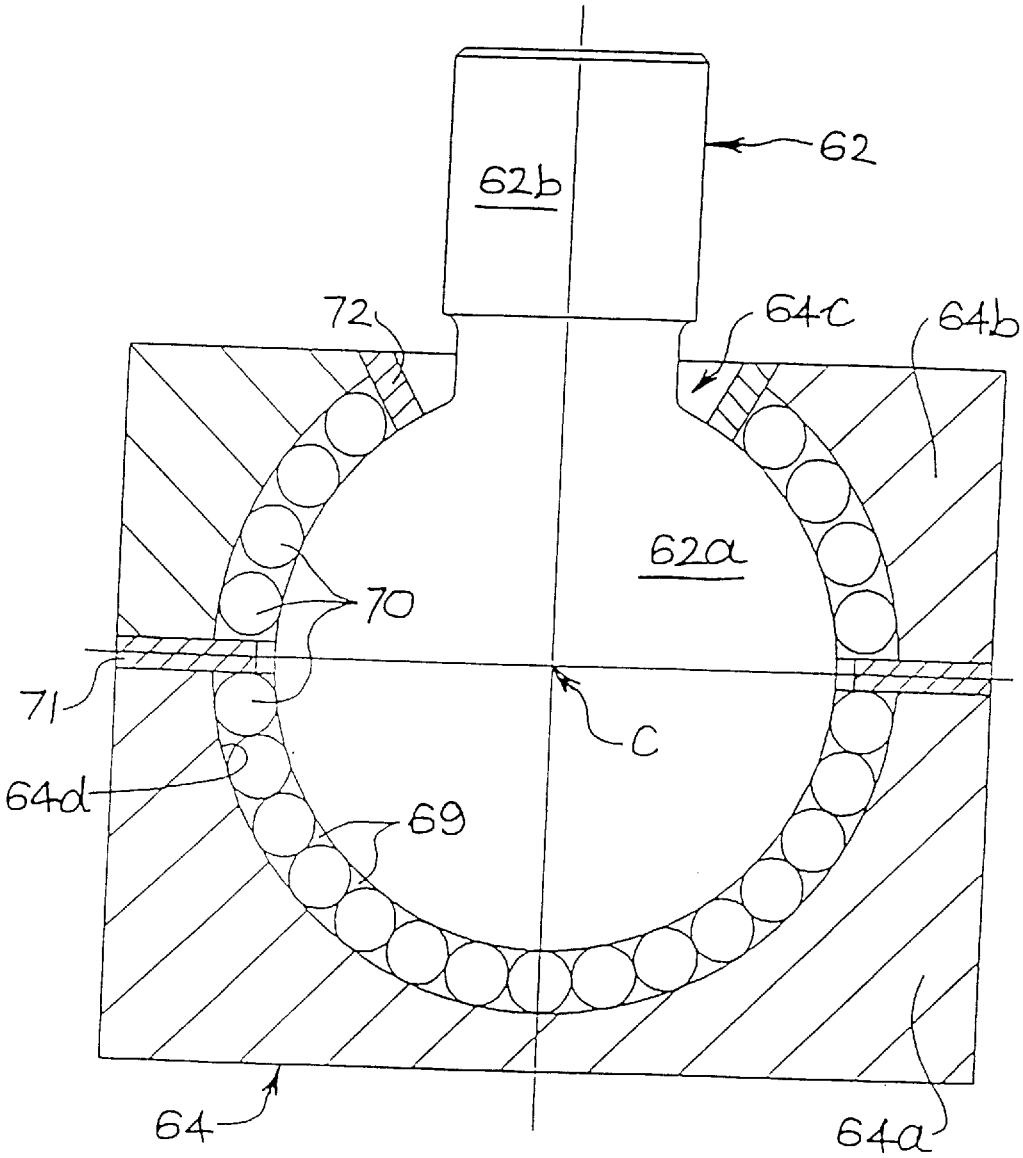
FIGS. 4 and 5 correspond to, but illustrate respective variants of the components of FIG. 3.

FIG. 4 shows and alternative arrangement for the components shown in FIG. 3 and, where relevant, the same reference numerals are used. In the arrangement of FIG. 4, casing 64 again encloses a volume, except at its open top 64*c*. Parts 64*a* and 64*c* together define a spherical internal bearing surface 64*d* which defines that volume, with the radius of surface 64*d* being greater than that of ball 62*a* of member 62. The resultant space 69 between surface 64*d* and ball 62*a* is filled with hard, spherical ball bearings 70 such that assembly 61 and ball 62*a* comprise a spherical crowded ball bearing in which ball 62*a* is the inner race and casing 64 is the outer race. The case 64 and bearing member 62 may be of cast iron or steel, while bearings 70 preferably are of steel.

In the arrangement of FIG. 4, an annular spacer 71 is provided between opposed surfaces of parts 64*a* and 64*b* of casing 64. As shown, spacer 71 preferably separates the respective bearings within each part 64*a* and 64*b*. Also, an annular retainer ring 72 is fitted around opening 64*c* to retain the bearings 70 within space 69.

Figure 5:
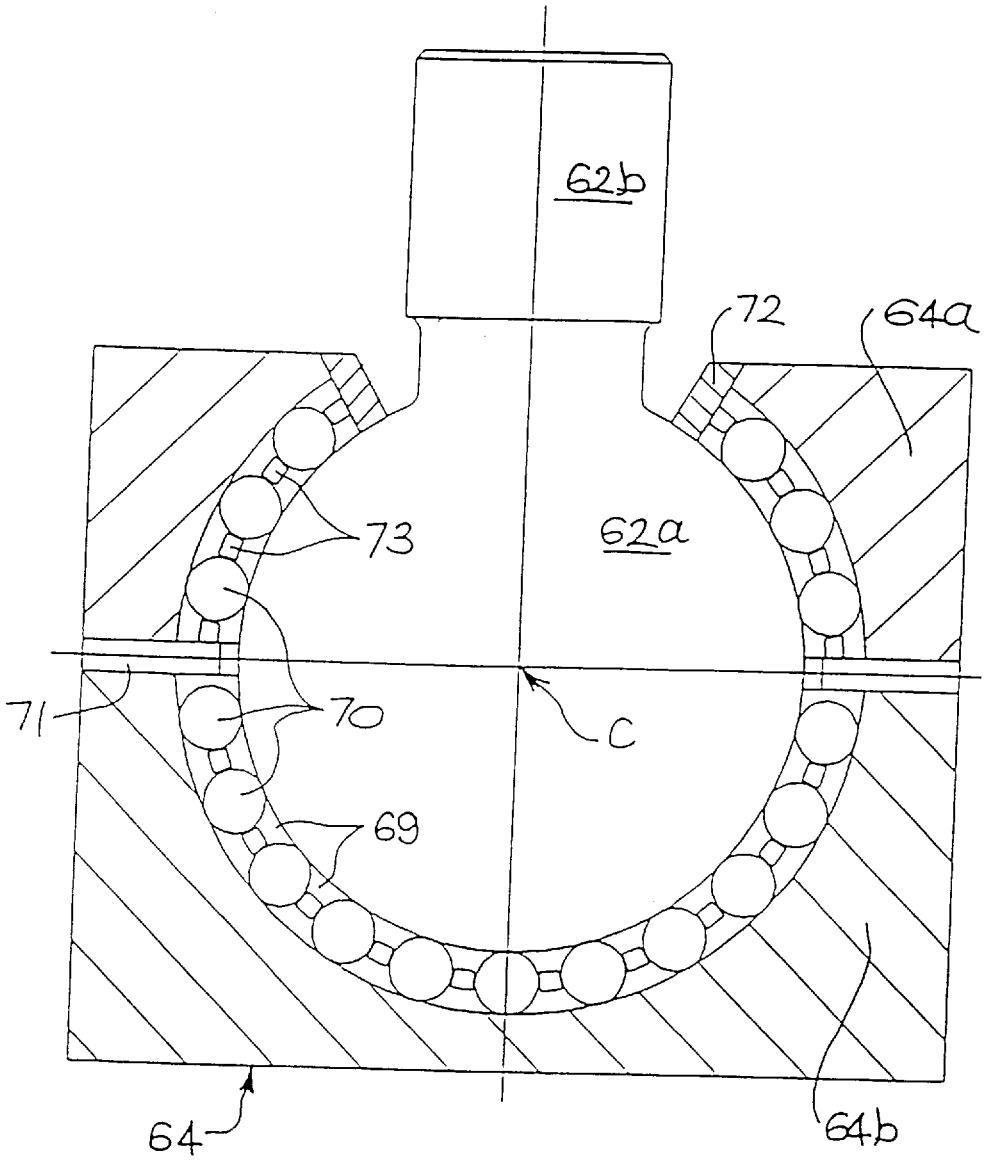

The further alternative arrangement of FIG. 5 readily will be understood from the description of FIG. 4. Corresponding parts have the same reference numerals. The principal differences of the arrangement of FIG. 5, compared with that of FIG. 4, are that a lesser number of bearings 70 are provided, with these being secured in spaced relationship within space 69 by provision of part-spherical separators or cages 73. The cages 73 can be of steel or other suitable metal, or they can be non-metallic such as of a suitable plastics material.

In each of FIGS. 4 and 5, the casing 64 is intended to be secured in a socket such as shown in FIG. 2 for casing 64 of crusher 110. However, as described in relation to the arrangement of FIG. 3, the casing 64 of each of FIGS. 4 and 5 may be secured on its socket and/or adjustable therein along central axis A—A. Again, casings 64 may be modified so as to be both secured and so adjustable in the manner described, with reference to knuckle 26 of FIG. 1, for casing 64 of FIG. 3.

Figure 6:
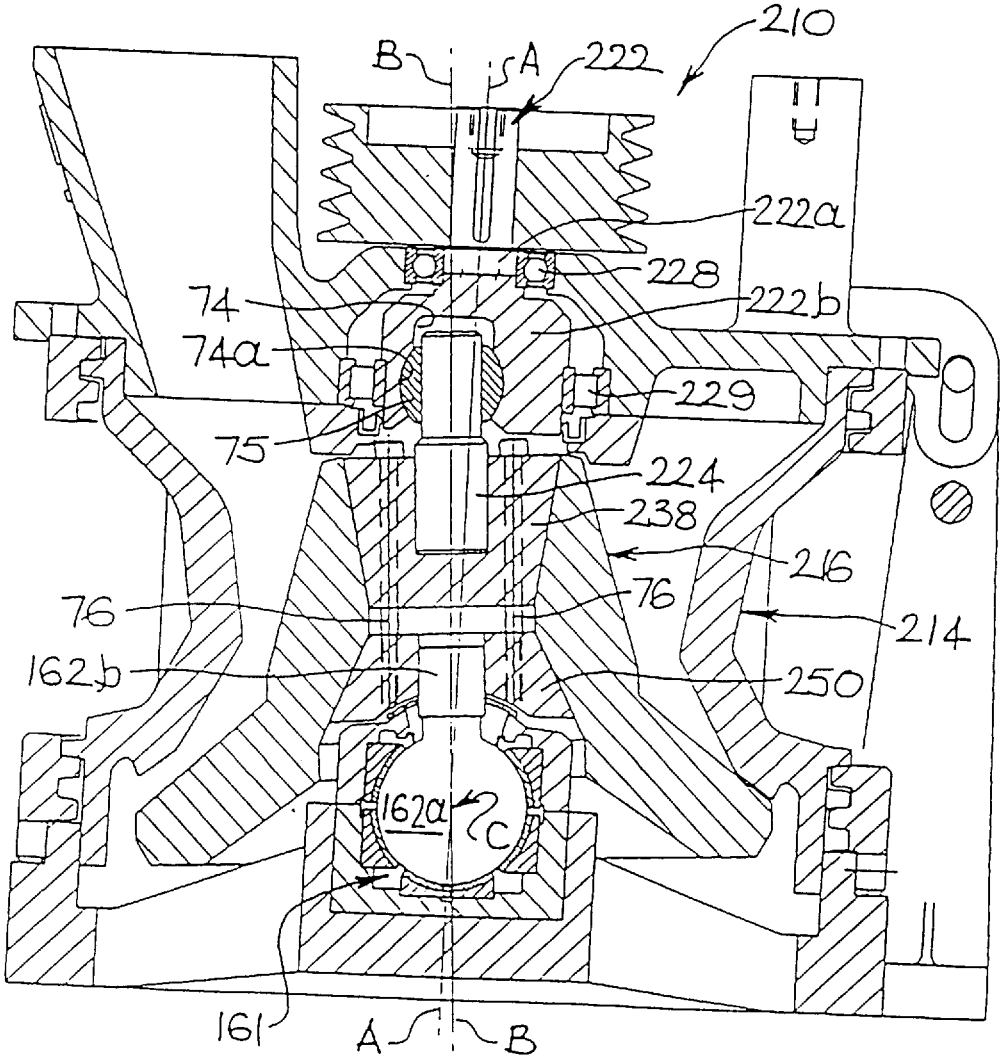
FIGS. 6 to 8 correspond to FIG. 2, but illustrate further respective embodiments of the invention.

FIG. 6 illustrates an alternative embodiment of a gyratory crusher according to the invention. As several components of this are similar to those of crusher 10 of FIG. 2, they are identified by the same reference numeral plus 100. The crusher 210 of FIG. 6 also enables retention of benefits, while obviating or minimising disadvantages, of crusher 10 of FIG. 1.

Description of crusher 210 will be limited to features by which it differs from crusher 110 of FIG. 2. As will be appreciated, the principal differences are with the mounting of upper shaft 222, and the arrangement for eccentric coupling between shaft 222 and lower shaft 224.

In crusher 210 upper shaft 222 is confined in the required vertical aspect, with its axis co-incident with central axis A—A of bowl 214, by rolling element bearings 228 and 229. The general arrangement is similar to that for crusher 110 of FIG. 2. However, shaft 222 is stepped to define a smaller diameter upper section 222*a* and a larger diameter lower section 222*b*, with there being a corresponding diametrical relationship between bearings 228 and 229. Also the larger lower section 222*b* is provided with a counter-bore 74 which is eccentric or off-set from the central axis A—A. Moreover, a groove 74*a* of part-spherical form is provided in the counter-bore 74. A part-spherical, self-aligning bearing 75 is provided in groove 74*a*, and the upper end of lower shaft 224 is journalled in bearing 75.

The eccentricity of bore 74 with respect to central axis A—A is such that, in combination with bearing member 162, location of the upper end of shaft 224 in bearing 75 retains the axis of shaft 224 co-incident with gyratory axis B—B. As with the arrangement of crusher 110 of FIG. 2, shaft 222 of crusher 210 is rotatable with drive to pulley 234. With such drive, shaft 222 is free to rotate relative to bearing 75. Also, while the lower end of shaft 224 is rigidly mounted in bearing housing 238, the upper end of shaft 224 is rotatable in or with bearing 75. Also, the upper end of shaft 224 is not constrained against axial movement in bearing 75, such as due to thermal expansion and contraction, thereby preventing the transmission of indeterminate axial forces to bearing 75 as a consequence of manufacturing or assembly inaccuracies or such thermal variation.

Rotation of shaft 222 causes movement of bearing 75 around a circular path concentric with central axis A—A. This movement causes corresponding movement of the upper end of shaft 224 and crushing head 216, such that head 216 and gyratory axis B—B move with the required gyratory motion. Again, the axes A—A and B—B intersect at point C in the relationship described with reference to crusher 110 of FIG. 2.

In crusher 210, forces generated during crushing of frangible and friable material are shared between bearing 75 on the one hand and ball 162*a* of member 162 and assembly 161 on the other hand. This sharing is essentially the same as that occurring with bearing 140 on the one hand and ball 62*a* and assembly 61 on the other hand in crusher 110 of FIG. 2.

In addition to the above matters, FIG. 6 shows upper and lower housings 238 and 250 secured and drawn together along gyratory axis B—B by bolts 76. This retains housings 238 and 250 at a required axial spacing and, while not shown, similar bolts can be provided, if required, between housing 138 and 150 of crusher 110 of FIG. 2.

As described in relation to crusher 110 of FIGS. 2 and 3, crusher 210 of FIG. 6 has its ball 162*a* constrained above and below a horizontal plane containing point C. Also, in a similar manner to that described for crusher 110 of FIGS. 2 and 3, the axes A—A and B—B in crusher 210 of FIG. 6 are at a fixed angle of inclination, such as shown, whereby axis B—B moves around a cone of revolution having its axis co-incident with axis A—A, during gyratory motion of head 216.

Figure 7:
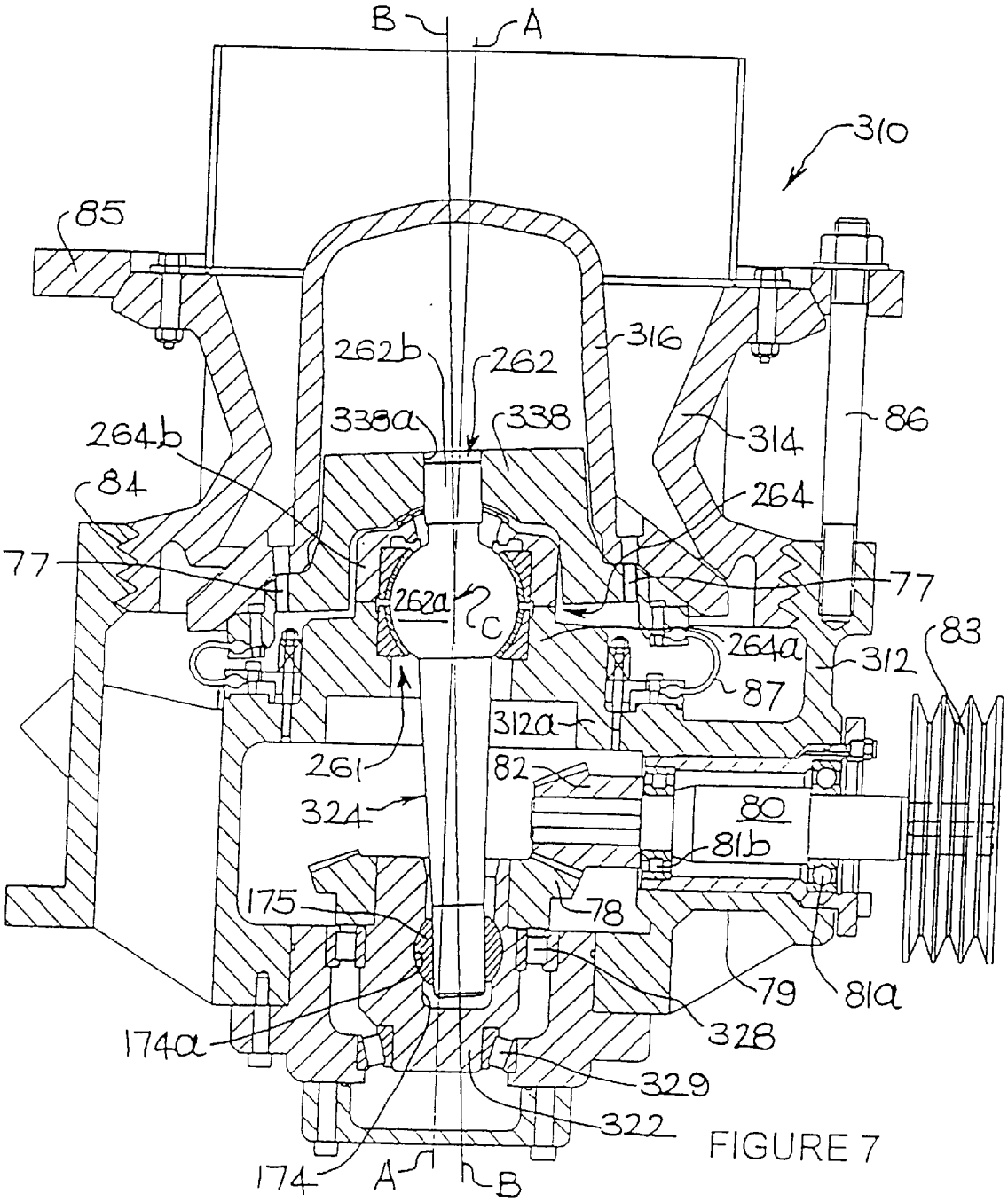

A further embodiment of a gyratory crusher 310 according to the present invention is shown in FIG. 7. Whereas each of crusher 110 of FIG. 2 and crusher 210 of FIG. 6 is top driven, crusher 310 is bottom driven. While crusher 310 seemingly is of a quite different construction than crusher 210 of FIG. 6, there in fact is a very substantial similarity. The principal difference, in addition to bottom rather than top drive in crusher 310, results largely from inversion of some components. Thus similar components, despite this inversion, have the same reference numerals as used in FIG. 6, plus 100.

In crusher 310, that referred to in previous embodiments as an upper shaft having its axis co-incident with central axis A—A of the bowl has a counterpart in lower shaft 322. The shaft previously referred to as a lower shaft having its axis co-incident with the gyratory axis B—B has a counterpart in shaft 324, while shaft 324 has an upper end portion thereof which defines, or is made integral with bearing member 262. The stem 262*b* of member 62 is co-axial with shaft 324 and is located in bore 338*a* of cylindrical housing 338. As shown, housing 338 is mounted within crushing head 316 by bolts 77. Again, axes A—A and B—B intersect at a point C, while point C is at or proximate to a plane extending across the lower end of head 316. Point C again is the centre of curvature of a bearing system providing for gyratory movement of head 316 within bowl 314, with that bearing system comprising bearing assembly 261 and ball 262*a* of bearing member 262. Also, lower casing section 264*a* of casing 264 is defined by a part 312*a* of crusher frame 312, with upper part 264*b* secured to part 264*a*.

Again, shaft 322 has a counter-bore 174 which is eccentric with respect to central axis A—A, with groove 174*a* around bore 174 housing a part-spherical self-aligning bearing 175. In crusher 210 of FIG. 6, shaft 224 and stem 162*b* of bearing member 162 are separate. However, in crusher 310, shaft 324 and stem 262*b* of member 262, with ball 262*a*, comprise parts of an integral member. Also, it is by stem 262*b* that shaft 324 is securely retained in bore 338*a* of housing 338, in the manner described for stem 62*b* in bore 150*c* in crusher 110 of FIG. 2, although shaft 324 again has an end (in this case a lower end) received in bearing 175.

At the upper end of shaft 322, there is provided a bevel gear 78 which is concentric with central axis A—A. Frame 312 has mounted therein a horizontally disposed sleeve 79 in which a drive shaft 80 is rotatable in bearings 81*a* and 81*b*. The inner end of shaft 80 has a pinion 82 which meshes with gear 78, while its outer end carries a pulley 83. Thus shaft 322 is rotatable under the action of drive means (not shown) coupled to pulley 83 and operable to rotate shaft 80.

As previously, rotation of shaft 322 causes movement of bearing 175 around a circular path concentric with axis A—A. This causes corresponding movement of the lower end of shaft 324 and, by virtue of ball 262*a* being retained in assembly 261, required gyratory movement of crushing head 316. Forces generated during crushing are shared between bearing 175 on the one hand and by ball 262*a* and assembly 261 on the other hand.

As shown, bowl 314 has threads 84 by which it is mounted on frame 312. A locking ring 85 is mounted on the top end of bowl 314 and, by tensioning of ties 86, locks bowl 314 at a required height. Also, crusher 310 has an annular resilient member 87 secured to head 316 and frame 312 for retarding rotation of head 316 on axis B—B during its gyratory motion.

As described in relation to crusher 110 of FIGS. 2 and 3, the ball 262*a* is constrained above and below a horizontal plane containing point C. Also, as described for crusher 110 of FIGS. 2 and 3, crusher 310 of FIG. 7 has its axes A—A and B—B intersecting at point C at a fixed angle of inclination, such as shown, whereby axis B—B traverses a cone of revolution having its axis co-incident with central, vertical axis A—A during gyratory motion of head 316. That fixed angle results from constraints due to the mounting of shaft 322 in bearings 328 and 329; the eccentricity of bore 174 of shaft 322; and the securement of member 262 such that its ball 262*a* is secured within fixed casing 264 with its centre co-incident with point C and its stem 262*b* secured in bore 338*a* of housing 338.

Figure 8:
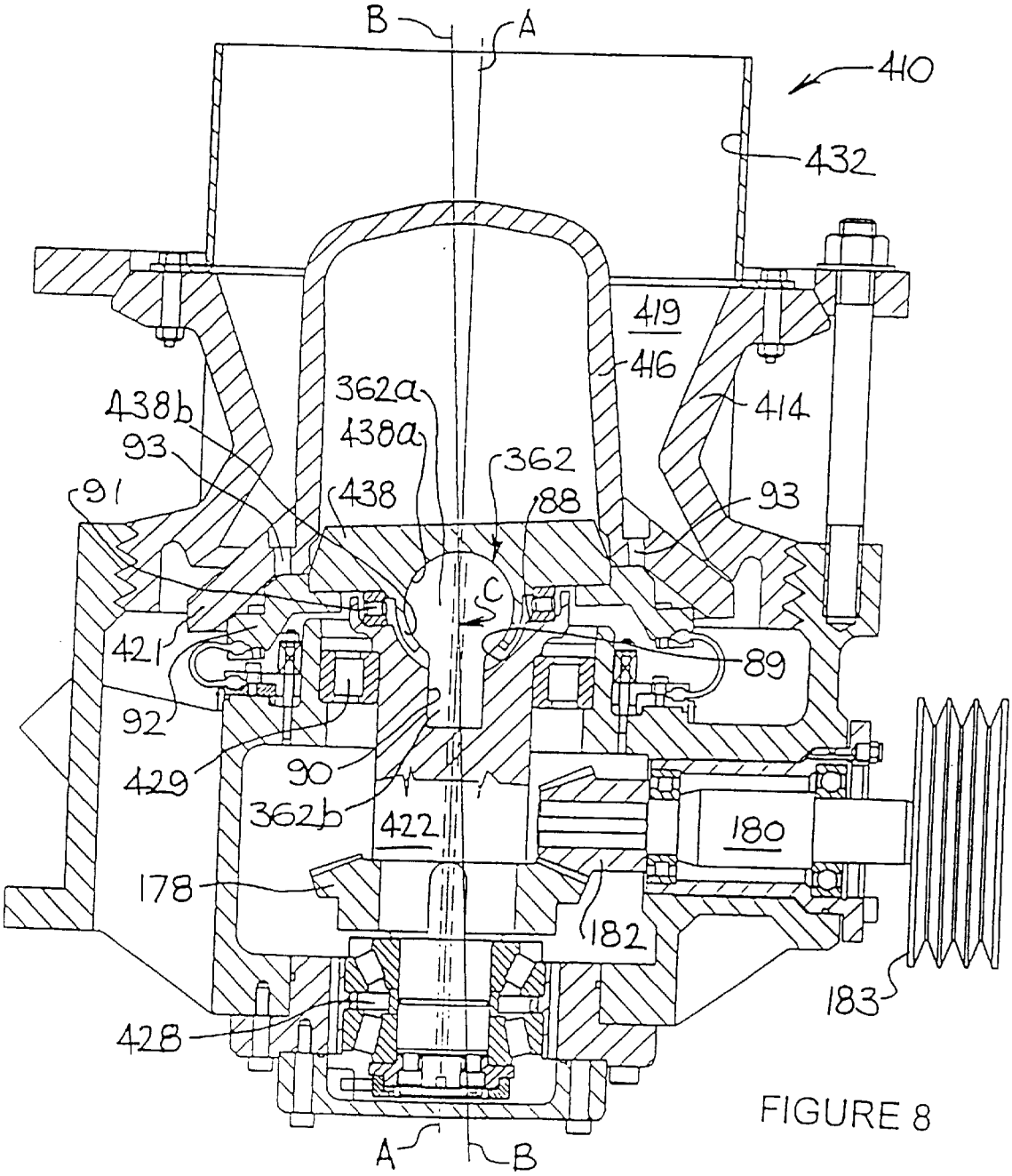

A further gyratory crusher 410 according to the present invention is shown in FIG. 8. Crusher 410 also has a bottom drive, although it represents a more radical departure from the crusher of FIGS. 2 and 6 than from crusher 410 of FIG. 7. However, with the preceding description, substantial detail of crusher 410 will be readily apparent and parts of crusher 410 corresponding to those of crusher 310 of FIG. 7 have the same reference numerals, plus 100.

In crusher 410, shaft 422 is rotatable by drive to shaft 180, via pulley 183, and meshing of the pinion 182 on shaft 180 with bevel gear 178 on shaft 422. Shaft 422 is confined in its vertical aspect by rolling element bearings 428 and 429 with its axis co-incident with central axis A—A of bowl 414. At the upper end of shaft 422, a bearing member 362 having a ball 362*a* and stem portion 362*b* is mounted, with the stem 362*b* secured in and rotatable with shaft 422 and such that the bearing member 362 has its axis of symmetry co-incident with axis A—A.

As shown, the upper end of shaft 422 is outwardly flared to define an annular land 88. Inwardly of the land 88, shaft 422 is recessed to define a concave part-spherical cavity 89 which has its centre of curvature at point C, on the central axis A—A. Shaft 422 has a counter-bore 90 extending axially from the cavity 89 in which the stem 362*b* of the bearing member 362 is secured, such as described in relation to FIG. 2 for securement of stem 62*b* in bore 150*c*. The depth of the counter-bore 90 is such that the ball 362*a* is located in, but spaced from, the defining surface of the cavity 89, and such that the centre of the ball 362*a* also is located at point C.

The land 88 is inclined with respect to a plane which is perpendicular to axis A—A. The angle of inclination of the land 88 to that plane is equal to the required inclination of the gyratory axis B—B for head 416 to the central axis A—A. Mounted on the land 88, there is a thrust bearing 91, such as a rolling element thrust bearing which has a medial plane parallel to the land 88 and containing point C.

Crushing head 416 is mounted on a bearing housing 438 of circular transverse section. Head 416 is secured in relation to housing 438 by means of a clamp ring 92 which engages the underside of housing 438 and is secured by bolts 93 to skirt 421 of head 416. Opening to its underside, the housing 438 defines a part-spherical cavity 438*a* which has a radius of curvature such that ball 362*a* is a neat fit therein. As cavity 438*a* receives a major part of ball 362, it will be appreciated that the representation of a depending skirt portion 438*b* of housing 438 is schematic and that it will need to comprise a separable portion to enable receipt of ball 362 in cavity 438*a*. However, the arrangement is such that, with member 362 mounted in relation to shaft 422 with the centre of ball 362*a* at point C, the centre of cavity 438*a* also is at point C, and point C is at or proximate to a plane extending across the lower end of head 416.

The arrangement of crusher 410 is such that, with rotation of shaft 422 on axis A—A, the eccentric mounting of head 416 on land 88 via bearing 91 results in required gyratory movement of head 416 on axis B—B relative to bowl 414. Thus frangible and friable material received into chamber 419, via inlet chute 432, is able to be crushed between head 416 and bowl 414. The crushing forces generated during crushing are transferred from head 416 to shaft 422 via bearing 91. All horizontal forces and random vertical axial forces are transferred from head 416 to ball 362*a* of member 362, via housing 438.

In a similar manner to the previously illustrated and described embodiments, the ball 362*a* of member 362 of crusher 410 is constrained above and below a horizontal plane containing point C, by substantial containment of the ball 362*a* within cavity 438*a* of housing 438 and also, in this case, by securement of stem 362*b* in bore 90 of shaft 422. Also, as in those previous embodiments, axis B—B of crusher 410 intersects axis A—A at point C at a fixed angle of inclination, such as shown. Thus, again, the axis B—B traverses a cone of revolution having its axis co-incident with the central, vertical axis A—A during gyratory motion of head 416. The fixed angle results from the mounting of shaft 422 in bearings 428 and 429; the indicated securement of stem 362*b* and ball 362*a* of member 362; and the tilted coupling resulting from land 88 and bearing 91 in providing an eccentric relationship between head 416 and shaft 422.

As previously indicated, the arrangement of FIG. 4 or FIG. 5 can substituted for that of FIG. 3, in crusher 110 of FIG. 2. Also, in each case, the relationship between the ball 62*a* of member 62 and bearing assembly 61 can be reversed. That is, member 62 can be inverted and mounted in relation to frame 112, with its stem 626 having its axis co-incident with central axis A—A, and with assembly 61 being inverted and mounted in relation to or forming a projection of housing 150.

Moreover, assembly 161 of crusher 210 of FIG. 6 could be modified to the form of assembly 61 of FIG. 4 or FIG. 5. Also, assembly 161 (or such modifications of it) and member 162 also can be reversed, as detailed above in relation to crusher 110 of FIG. 2.

In each of the crushers of FIGS. 2, 6, 7 and 8, the arrangement is such that a plane perpendicular to axis B—B, across the lower effective extent of the crushing head at which crushing occurs, is proximate to or co-incident with the intersection of axes A—A and B—B at point C. While not essential, this is desirable for reasons detailed above.

As previously indicated, it is necessary, in the known crusher 10 of FIG. 1, for axes A—A and B—B to intersect at point C of knuckle 26. Without this, due to minor error in manufacture and/or assembly, unintended and uncontrolled excessive forces can reduce the life of components to a small fraction of their intended life, and crusher 10 can become self-destructive. In crusher 110 of FIG. 2, and in the described modifications of crusher 110, the arrangement facilitates attainment of intersection of axes A—A and B—B with point C of ball 62*b* and assembly 61, as is desirable, although this is not necessary for reliable operation. Since bearing 140 is able to self-align and move slideably on shaft 124, without imposing unintended or uncontrolled forces on any components, the intersection of gyratory axis B—B with central axis A—A need not co-incide with point C. The same applies in crusher 210 of FIG. 6 and crusher 310 of FIG. 7, and to the described modifications of these, due to axial movement of shaft 224 in bearing 75 in the case of FIG. 6, and of shaft 324 in bearing 175 in the case of FIG. 7. The same practical benefit also is possible in crusher 410 of FIG. 8, and modifications of this. Optimum attainment of the benefit in crusher 410 can necessitate use, for example, of a bearing 91 in which relative movement is possible, between its upper and lower races, parallel to a plane perpendicular to the gyratory axis B—B. However, in crusher 410 of FIG. 8, at least partial alleviation of the difficulty which can arise with crusher 10 of FIG. 1 is achieved since the arrangement of crusher 410 minimises the extent to which the intersection of axes A—A and B—B can depart from point C as a result of accumulation of manufacturing and/or assembly tolerance variations.

Finally, it is to be understood that various alterations, modifications and/or additions may be introduced into the constructions and arrangements of parts previously described without departing from the spirit or ambit of the invention.

I claim:

1. A gyratory crusher for crushing frangible or friable material; the crusher including a frame; a bowl mounted in relation to said frame, said bowl having a substantially vertical central axis and defining a chamber for receiving frangible or friable material to be crushed and a discharge opening at the base thereof through which crushed material is able to discharge; a crushing head mounted in said bowl on a gyratory axis which is inclined with respect to the central axis, with the central and gyratory axes intersecting at an angle which is substantially fixed in use of the crusher and at a location which is substantially in a plane extending across the lower effective end of said crushing head; and a drive assembly, including a drive shaft confined so that its longitudinal axis is substantially co-incident with the central axis and drive means for rotating the drive shaft, for imparting gyratory motion to said head whereby frangible or friable material received into said chamber is subjected to crushing action, between an inner peripheral surface of said bowl and an outer peripheral surface of said head, as said head is driven in its gyratory motion; wherein the crusher further includes a bearing system by which said crushing head is mounted whereby the gyratory axis intersects the central axis at said substantially fixed angle, said bearing system including a first bearing component which is secured in relation to said crushing head and a second component which is mounted in relation to said frame, one of said first and second bearing components including a bearing member which has a part-spherical ball and a stem which projects from the ball, and the other of said first and second components including a bearing housing which defines a part-spherical cavity in which the ball is received and substantially fully enclosed in the cavity, whereby the intersection of the gyratory and central axis at said substantially fixed angle is located substantially at a common centre of the ball and cavity and gyratory movement of said crushing head is permitted by corresponding movement of said first bearing component with respect to the other said bearing component; and wherein the stem, of the bearing member of the one bearing component, extends with clearance through the bearing housing of the other bearing component, with the stem having a longitudinal axis substantially co-incident with the gyratory axis and the stem providing means by which the first component is secured in relation to the crushing head where the one bearing component is the first component, and with the stem having its longitudinal axis substantially co-incident with the central axis and the stem providing means by which the second component is secured in relation to the frame where the one bearing component is the second component.

2. A gyratory crusher according to claim 1, wherein said one bearing component is said first component, and the stem is located securely in a housing on which the crushing head is mounted.

3. A gyratory crusher according to claim 2, wherein the drive assembly for imparting gyratory motion to the crushing head is located below the crushing head and further includes a gyratory shaft on which said crushing head is located and which has its longitudinal axis substantially co-incident with the gyratory axis; wherein an upper end of the drive shaft defines a counter-bore which is eccentric with respect to the central axis, and an eccentric coupling is provided between the drive shaft and the gyratory shaft by a lower end of the gyratory shaft being located in a part-spherical, self-aligning bearing provided in the counter-bore; and wherein the gyratory shaft has an upper end which is connected to, or integral with, the ball and extends with clearance through the bearing housing of the other component in a direction oppositely with respect to the stem.

4. A gyratory crusher according to claim 2, wherein the part-spherical cavity is defined by bearing material against which an external surface of the ball is in direct bearing engagement.

5. A gyratory crusher according to claim 2, wherein the part-spherical cavity has a radius greater than that of the ball and the ball is in bearing engagement in the bearing housing by means of a plurality of ball bearings contained therebetween.

6. A gyratory crusher according to claim 1, wherein said one bearing component is said second component, and the stem is located securely in a bearing or housing fixed in relation to the frame.

7. A gyratory crusher according to claim 6, wherein the drive assembly for imparting gyratory motion to the crushing head is located below the crushing head and further includes a coupling between an upper end of the drive shaft and the stem such that the drive shaft and the stem are rotatable together; and wherein the crusher further includes an eccentric engagement between the drive shaft and a lower end of, or a housing within, the crushing head whereby the eccentric engagement imparts required gyratory movement to the head.

8. A gyratory crusher according to claim 7, wherein the eccentric engagement between the drive shaft and the lower end of said crushing head, or a housing within the crushing head, is at an inclined end face of said drive shaft, located in a plane which is substantially perpendicular to the gyratory axis and which contains the point of intersection of the central and gyratory axes.

9. A gyratory crusher according to claim 6, wherein the part-spherical cavity is defined by bearing material against which an external surface of the ball is in direct bearing engagement.

10. A gyratory crusher according to claim 6, wherein the part-spherical cavity has a radius greater than that of the ball and the ball is in bearing engagement in the bearing housing by means of a plurality of ball bearings contained therebetween.

11. A gyratory crusher according to claim 1, wherein the part-spherical cavity is defined by bearing material against which an external surface of the ball is in direct bearing engagement.

12. A gyratory crusher according to claim 1, wherein the part-spherical cavity has a radius greater than that of the ball and the ball is in bearing engagement in the bearing housing by means of a plurality of ball bearings contained therebetween.

13. A gyratory crusher according to claim 12, wherein said one bearing component is said first component, and the stem is located securely in a housing on which the crushing head is mounted.

14. A gyratory crusher according to claim 12, wherein said one bearing component is said second component, and the stem is located securely in a bearing or housing fixed in relation to the frame.

15. A gyratory crusher according to claim 12, wherein the part-spherical cavity is defined by bearing material against which an external surface of the ball is in direct bearing engagement.

16. A gyratory crusher according to claim 1, wherein said drive assembly for imparting gyratory motion to said crushing head further includes a gyratory shaft on which said crushing head is located and which has its longitudinal axis substantially co-incident with the gyratory axis; and wherein said drive shaft and said gyratory shaft are in an eccentric relationship.

17. A gyratory crusher according to claim 16, wherein the drive assembly is located above the crushing head and said drive shaft and said gyratory shaft comprise parts of a unitary shaft assembly.

18. A gyratory crusher according to claim 16, wherein the drive assembly is located above the crushing head and said drive shaft and said gyratory shaft are separable and have an eccentric coupling therebetween.

19. A gyratory crusher according to claim 18, wherein a lower end of the drive shaft defines a counter-bore which is eccentric with respect to the central axis, and the eccentric coupling is provided by an upper end of the gyratory shaft being located in a part-spherical, self-aligning bearing provided in the counter-bore.

* * * * *